United States Patent [19]

Nakamura et al.

[11] Patent Number: 4,841,193

[45] Date of Patent: Jun. 20, 1989

[54] FLUORESCENT LAMP DEVICE WITH INCANDESCENT BULB TYPE BASE CAP

[75] Inventors: Naoyuki Nakamura, Bizen; Masashi Sangen, Kobe, both of Japan

[73] Assignee: Matsushita Electronics Corporation, Kadoma, Japan

[21] Appl. No.: 153,363

[22] Filed: Feb. 8, 1988

[30] Foreign Application Priority Data

Feb. 10, 1987 [JP] Japan ..... 62-29087

[51] Int. Cl.[4] ..... H01J 61/30

[52] U.S. Cl. ..... 313/318; 313/493; 313/634; 439/234

[58] Field of Search ..... 313/493, 634, 318; 439/11, 13, 232, 234, 238, 240, 615

[56] References Cited

U.S. PATENT DOCUMENTS 4,405,877 9/1983 Haraden et al. ..... 313/318

*Primary Examiner*—Kenneth Wieder

*Attorney, Agent, or Firm*—Spencer & Frank

[57] ABSTRACT

A fluorescent lamp device with an incandescent bulb type base cap. The fluorescent lamp device has a luminous tube unit and a case with one end supporting the luminous tube unit, and the other end has an outwardly projecting portion. A ballast is provided in the case, and a base cap is adapted to be rotatably fitted to the projecting portion of the case. The outer periphery of the projecting portion of the case has an engagement groove formed in it and a stopper portion which is formed in the axial direction of the case. An engagement portion, a guide groove and a rotation limiting groove having a rotation stopper portion are successively provided for the inner surface at one end of the base cap disposed in that order starting from the one end of the base cap. By fitting the engagement portion of the base cap in the engagement groove of the case, fitting one end of the projecting portion of the case in the guide groove of the base cap, fitting the stopper portion of the base cap in the rotation limiting groove of the base cap, and rotating the stopper portion so that it is fitted in the rotation limiting groove, the luminous tube unit and the case can be rotatably fitted to the base cap, and rotation of the stopper portion can be prevented by the rotation stopper portion.

5 Claims, 3 Drawing Sheets

FLUORESCENT LAMP DEVICE WITH INCANDESCENT BULB TYPE BASE CAP

BACKGROUND OF THE INVENTION

1. FIELD OF THE INVENTION

This invention relates to a fluorescent lamp device with an incandescent bulb type base cap.

2. DESCRIPTION OF THE PRIOR ART

A variety of types of fluorescent lamp devices with incandescent bulb type base caps have recently been put into practical use for the purpose of replacing conventional incandescent bulbs. Such fluorescent lamp devices are constituted in such a manner that a luminous tube, a ballast and a starter are contained in an outer case consisting of a globe and a case, and the base of the luminous tube is fitted to the case. Since fluorescent lamp devices of the type described above offer potential for a variety of designs, they can play the role of serving as a form of interior design. The inventor of the present invention has produced and examined a variety of fluorescent lamp devices with incandescent bulb type base caps in which no globe is provided, the luminous tube unit being exposed to the exterior so that the light emitted from the fluorescent tube unit can be effectively utilized and, at the same time, a novel design created.

However, when a multiplicity of the above described fluorescent lamp devices is used in the lighting of, for example, a shop, the luminous tube units are directed randomly in a variety of ways so an attractive lighting scheme cannot be achieved because the incandescent bulb type base cap is screw-driven into a socket of a device. Furthermore, in a case where, for example, a rectangular drive device and a fluorescent lamp device with an incandescent bulb type base cap, comprising a luminous tube unit consisting of four integrated straight glass luminous tubes connected to each other are combined, the positional relationship between the rectangular drive device and the fluorescent lamp device cannot be maintained so that the appearance of the connection between the rectangular drive device and the fluorescent lamp device cannot be kept attractive.

OBJECTS AND SUMMARY OF THE INVENTION

An object of the present invention is to provide a fluorescent lamp device with an incandescent bulb type base cap in which the direction of the luminous tube unit thereof can be properly aligned at all times.

Another object of the present invention is to provide a fluorescent lamp device with an incandescent bulb type base cap in which disconnection of a lead wire of the luminous tube unit can be prevented if the direction of the luminous tube unit is properly aligned.

A fluorescent lamp device with an incandescent bulb type base cap according to the present invention comprises, a luminous tube unit, a case one end of which supports the luminous tube unit, and the other end of which is provided with an outwardly projecting portion, and which has a ballast therein, and a base rotatably fitted to the projecting portion of the case. The outer periphery of the projecting portion of the case is provided with an engagement portion and a stopper portion which is formed in the axial direction of the case. An engagement portion, a guide groove and a rotation limiting groove with a rotation stopper portion are provided successively on the inner surface of one end of the base in that order starting from the one end of the base. As a result of this structure, by fitting the engagement portion of the base in the engagement groove of the case, fitting the end portion of the projecting portion of the case in the guide groove of the base, fitting the stopper portion of the base in the rotation limiting groove of the base, and rotating the stopper portion into the rotation limiting groove, the luminous tube unit and the case can be rotatably fitted to the base, and rotation of the stopper portion is prevented by the rotation stopper portion.

DESCRIPTION OF THE PREFERRED EMBODIMENT

Figure 1:
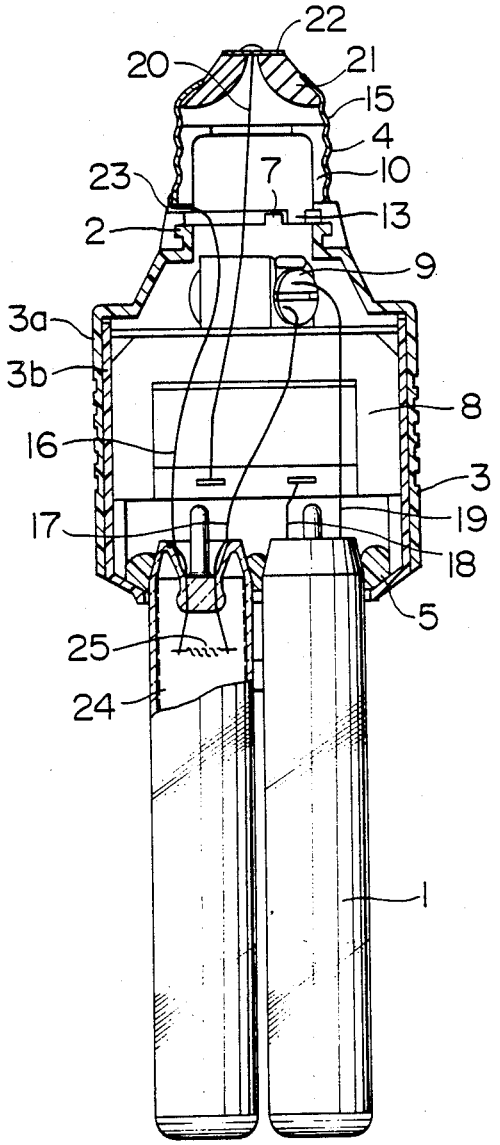
FIG. 1 is a cross-sectional view, from which a part is omitted, of a fluorescent lamp device with an incandescent bulb type base cap according to an embodiment of the present invention.
Figure 2:
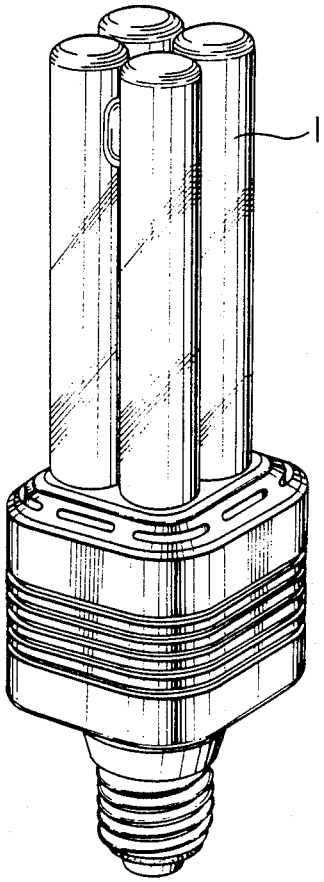
FIG. 2 is a perspective view of the same.

Referring to FIGS. 1 and 2, a fluorescent lamp device with an incandescent bulb type base cap according to the present invention has a luminous tube unit 1, a case 3 whose one end supports the luminous tube unit 1 and whose other end is provided with an outwardly projecting portion 2, and a base cap 4 which is rotatably fitted to the projection portion 2.

The luminous tube unit 1 includes four fluorescent tubes each having an inner surface coated with a fluorescent coating film 24, the four fluorescent tubes being arranged adjacent each other with intersections of their longitudinal axes with a plane perpendicular thereto forming a rectangle in the plane so that the four tubes essentially form one luminous tube. Each of two of the four tubes has an electrode 25 at one end thereof, and mercury and rare gases are enclosed in each of the glass tubes.

Figure 4:
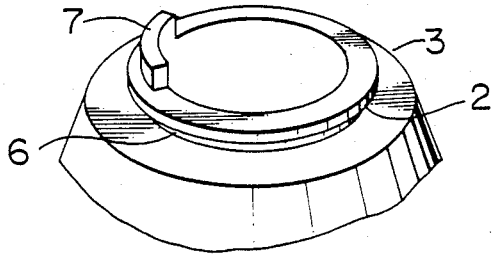
FIG. 4 is a perspective view of a projecting portion of a case.

The case 3 is made of plastic, and is constituted by an outer case **3*a* and an inner case 3*b* which is inserted into the outer case 3*a*. The inner case 3*b* serves as the portion for supporting the luminous tube unit 1. One end of the luminous tube unit 1 is stuck to the support portion by an adhesive 5. The outer periphery of the projecting portion 2 of the case 3 is, as shown in FIG. 4, provided with an engagement groove 6 and a stopper portion 7 which is formed in the axial direction of the case 3. The case 3 is provided with a ballast 8 and a starter 9** therein.

Figure 3:
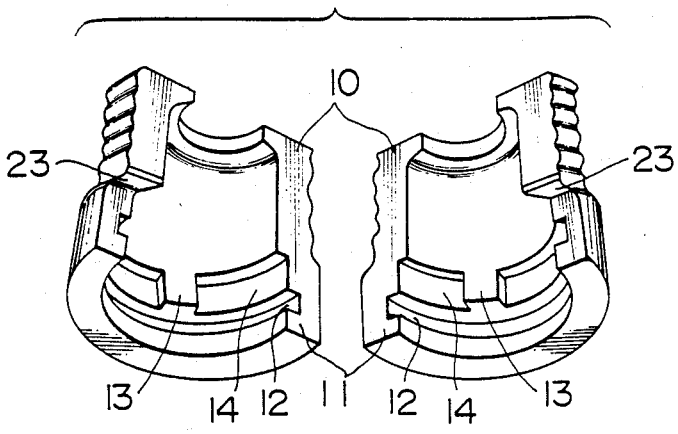
FIG. 3 is a perspective view of a main base body.

Reference numeral 23 shown in FIGS. 1 and 3 represents a hole through which a lead wire to be described hereinafter is drawn.

A plastic main body 10 of the base cap 4 is arranged to be in two pieces as shown in FIG. 3, wherein the inner surface of one end is provided with an engagement portion 11, a guide groove 12 and a rotation limiting groove 14 with a rotation stopper portion 13 which are disposed in that order starting from the one end. The flat portions of the two pieces are brought into abutment with each other so as to form a cylindrical shape. A spiral groove formed in the outer periphery of the main body 10 of the base cap 4 is provided with a base outer cover 15. A metallic eyelet 22 is fitted to the base outer cover 15 through an insulator 21.

Figure 5:
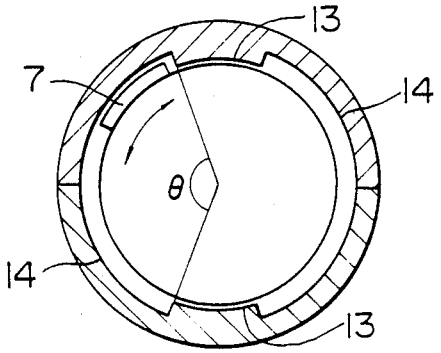
FIG. 5 illustrates the rotation of the case with respect to the base.

The manner in which the base cap 4 is fitted to the projecting portion 2 of the case 3 will now be described. The end portion of the projecting portion 2 of the case 3 is fitted in the guide groove 12 of the main body 10, and the stopper portion 7 is fitted in the rotation limiting groove 14 of the main body 10, which allows the stopper portion 7 to be rotated within the rotation limiting groove 14, as shown in FIG. 5.

The electrical connection of the luminous tube unit 1, ballast 8, starter 9 and the base 4 will now be described. As shown in FIG. 1, a lead wire 16 to the luminous tube unit 1 is connected to the base outer cover 15 through the drawing hole 23 and a lead wire 17 is connected to one of the lead wires of the starter 9, while a lead wire 18 is connected to one of the terminals of the ballast 8 and a lead wire 19 is connected to another lead wire of the starter 9. Another terminal of the ballast 8 and the eyelet 22 are connected by means of a lead wire 20.

The fluorescent lamp device with an incandescent bulbs type base cap has the constitution described above. As a result of the structure, by screwing the base cap 4 into a socket (omitted from illustration) of the device, and rotating clockwise or counterclockwise the luminous tube unit 1 secured to the case 3, the stopper portion 7 of the case 3 is rotated within the rotation limiting groove 14 of the main body 10 (in this embodiment the angle $\theta=140°$). Therefore, the direction in which the luminous tube unit 1 and the case 3 face can be freely arranged with respect to the base cap 4. Therefore, when the luminous tube unit 1 and so on are positioned in a required position, the rotation can be stopped. As a result of this, if a multiplicity of these fluorescent lamp devices is used for lighting a space such as a shop, the directions of the luminous tube unit 1 and the case 3 can always be aligned as required. Further, when the stopper portion 7 comes into contact with the rotation stopper portion 13, the rotation is stopped. As a result of this, breakage of the lead wires 16 to 20 due to overrotation of the luminous tube unit 1 and so forth can be prevented.

What is claimed is:

1. A fluorescent lamp device comprising:

a luminous tube unit including four glass tubes, each having a longitudinal axis, arranged so that the intersections of said axes with a plane perpendicular thereto form a rectangle in said plane, each of said tubes having a fluorescent coating on an inner surface thereof and being charged with mercury and rare gases, each of two of said four glass tubes being further provided at one end with an electrode projecting from the inside of said tube to the exterior thereof;

a case having one end secured to said luminous tube unit for the support thereof, the other end of said case being provided with an outwardly projecting portion having an engagement groove in its outer peripheral surface, the outwardly projecting portion of said case further including a stopper portion extending in the direction of said longitudinal axes away from said luminous tube unit;

a ballast located within said case; and a base cap including a main body having an outer peripheral surface at one end provided with a spiral groove and a base outer cover fitted on to said groove, said main body further having an inner peripheral surface at the other end thereof provided with an engagement portion, a guide groove and a rotation limiting groove in that order starting from said other end of said main body, said base cap being rotatably secured to said case with the engagement portion of said main body fitting within the engagement groove of said case, the outwardly projecting portion of said case fitting within the guide groove of said main body and the stopper portion of said case fitting within the rotation limiting groove of said main body, whereby said luminous tube unit is rotatable with respect to said base cap, excessive rotation thereof being prevented by engagement of the stopper portion of said case with an end of the rotation limiting groove of said base cap.

2. A fluorescent lamp device comprising:

a luminous tube unit including a plurality of adjacent fluorescent tubes each having a longitudinal axis extending parallel to the longitudinal axis of at least one other of said plurality of tubes;

a case having one end secured to said luminous tube unit for the support thereof, the other end of said case being provided with an outwardly projecting portion having an engagement groove in its outer peripheral surface, the outwardly projecting portion of said case further including a stopper portion extending in the direction of said longitudinal axes away from said luminous tube unit; and a base cap including a main body having an outer peripheral surface at one end and an inner peripheral surface at the other end thereof, said inner peripheral surface being provided with an engagement portion, a guide groove and a rotation limiting groove in that order starting from said other end of said main body, said base cap being rotatably secured to said case with the engagement portion of said main body fitting within the engagement groove of said case, the outwardly projecting portion of said case fitting within the guide groove of said main body and the stopper portion of said case fitting within the rotation limiting groove of said main body, whereby said luminous tube unit is rotatable with respect to said base cap, excessive rotation thereof being prevented by engagement of the stopper portion of said case with an end of the rotation limiting groove of said base cap.

3. A fluorescent lamp device as defined by claim 2 which further comprises a ballast located within said case.

4. A fluorescent lamp device as defined by claim 2 wherein said luminous tube unit includes four fluorescent tubes, each having a longitudinal axis, arranged so that the intersections of said axes with a plane perpendicular thereto form a rectangle in said plane.

5. A fluorescent lamp device as defined by claim 1 which further comprises a started located within said case and a metallic eyelet adjacent and insulated from the outer cover of said base cap, said eyelet being electrically connected to a terminal of said ballast, the other terminal of said ballast, said starter and the outer cover of said base cap being electrically connected to said luminous unit.

* * * * *